US006471259B1

(12) United States Patent
Weyerstall et al.

(10) Patent No.: US 6,471,259 B1
(45) Date of Patent: Oct. 29, 2002

(54) ELECTRICALLY OPERATED LOCK FOR DOORS OF MOTOR VEHICLES OR THE LIKE

(75) Inventors: Bernd Weyerstall, Wuppertal; Bernardo Erices, Berg.-Gladbach, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/557,837

(22) Filed: Apr. 26, 2000

(30) Foreign Application Priority Data

Apr. 29, 1999 (DE) ..... 199 19 765

(51) Int. Cl.[7] ..... E05C 3/06
(52) U.S. Cl. ..... 292/201; 292/216; 292/DIG. 23
(58) Field of Search ..... 292/201, 216, 292/DIG. 23

(56) References Cited

FOREIGN PATENT DOCUMENTS

| | | |
|---|---|---|
| DE | 29 49 319 | 6/1980 |
| DE | 31 50 620 | 6/1983 |
| DE | 32 42 527 A1 | 5/1984 |
| DE | 32 42 527 C2 | 2/1987 |
| DE | 38 36 771 | 1/1990 |
| DE | 43 21 586 | 1/1994 |
| DE | 196 50 661 | 6/1998 |
| DE | 197 10 531 | 9/1998 |
| DE | 197 14 992 | 9/1998 |
| DE | 197 25 416 | 1/1999 |
| EP | 0 496 736 | 8/1992 |
| EP | 0 589 158 | 3/1994 |

*Primary Examiner*—Teri Pham Luu
(74) *Attorney, Agent, or Firm*—Nixon Peabody LLP; David S. Safran

(57) ABSTRACT

A lock for doors of motor vehicles or the like includes a lock catch component mounted for movement between an initial open position and a fully closed position through an intermediate position and includes preliminary and a final abutment. A lock latch component is mounted for displacement between an arresting position and a releasing position in which it engages and disengages one of the preliminary and final abutment of the lock catch component to hold the latter in and release the same for movement out of the intermediate and fully closed position, respectively. An electrically powered auxiliary opening drive is designed to cause the lock latch component to disengage the one of the abutments of the lock catch component to release the latter for movement toward the initial open position. An electrically powered auxiliary closing drive is provided to move the lock catch component from its intermediate into its fully closed position and includes a step-down transmission that is connected with the lock latch component via a driving element and a coupling interposed between the driving element and the lock latch component. The auxiliary closing drive is designed to also be able to act on the lock latch component when necessary. A control device first determines the occurrence of an emergency situation involving the action on the lock catch component of excessive forces making it necessary to employ the auxiliary closing drive to accomplish the disengagement, and then operates the auxiliary closing drive in such a manner after a demand for opening the lock has been issued in the emergency situation that it acts to disengage the lock latch component from the lock catch component.

9 Claims, 5 Drawing Sheets

ELECTRICALLY OPERATED LOCK FOR DOORS OF MOTOR VEHICLES OR THE LIKE

BACKGROUND OF THE INVENTION

1. Field of the Invention

The present invention relates to locks in general, and more particularly to locks that are operated by motors, especially electric motors, and that are well suited for use in motor vehicles to secure such parts as doors, hatches and/or hoods.

2. Description of the Related Art

Motor vehicle locks of the type referred-to above have already been known and used for many years in a variety of constructions and employing a variety of structural and operational principles; a more recent trend is to install such locks in passenger cars not only at the high end of the price spectrum but even in the intermediate range. Electrically powered drives equipped with worm gear transmissions are especially popular choices for this application, the main reason for this preference being their particularly small dimensions. Typically, the output element of such a drive is so connected to the lock catch component that the latter is capable of conducting free movement in the closing sense. This feature is based on the consideration that even a powerful slamming of the car door should result in entrainment of the lock catch component ahead of the drive output element.

Typically, when an auxiliary closing drive that is powered by a motor, especially an electric motor, is employed, it is activated only after the lock catch component has already reached its preliminary closing position. This preliminary closing position is ordinarily that in which the catch component is situated at a preliminary abutment or slightly behind it in the closing direction (overstroke). From there, the catch component is moved by the motor-powered drive in the closing direction, ordinarily one in which the main abutment of the catch component is engaged. The displacement of the lock catch component into its main closing position by means of the corresponding output component of the auxiliary closing drive is, however, often plagued by the problem that, should the output element of the drive come to a stop before the corresponding force-transmitting surface of the lock catch component had been reached, the motor vehicle door may become blocked. Moreover, even during the closing operation itself, that is in the course of closing the vehicle door by means of the auxiliary closing drive, there may arise emergency situations; for instance, adornment chain links or garment pieces may become caught between the door and the door frame. To address this issue, it has already been proposed to employ, as revealed for instance in the European patent document EP-B-0 496 736, mechanical, keyactivated emergency release elements, or coupling linkages or levers that are liftable manually, for instance via the external door handle, as disclosed for example in the German patent document DE-A-38 36 771.

In a known lock for automobile doors or the like (that disclosed in the German patent document DE-A-197 14 992) of which the present invention is a further development, there is provided an uncoupling possibility for the auxiliary closing drive in emergency situations that operates without the need for applying mechanical action or influence from the outside on the lock mechanism. To this end, an electromagnetic coupling is integrated into the step-down transmission embodied in the vehicular door lock of this type, this coupling serving to couple the electrical driving motor with or uncouple it from the driving element. In this construction, the engaged electromagnetic coupling is disengageable even while the electric driving motor is running, in dependence on the satisfaction of an uncoupling criterion. A preferred criterion is the pulling on the external (or the internal) door handle; this starts an electrically executed or performed switching process that leads to or results in the disengagement of the electromagnetic coupling. This corresponds on purpose to the intuitive action taken by the affected person even in the context of a motor vehicle equipped with purely mechanical vehicle door locks when confronted with the need for quickly opening the car door again while the door closing process is already on its way or had even been completed, for instance to release a coat portion clamped between the door and the vehicle body.

In the just referred-to patent document, it is further explained that one could also use, as alternatives to the above solution, a switching off of the drive motor or reversal in the sense of rotation of the electric drive motor of the auxiliary closing drive, on the basis of the release triggering criterion or event.

With respect to further previously proposed technical solutions relevant to this theme, and also to examples of auxiliary closing drives corresponding thereto, attention may and hereby is directed to the aforementioned German patent document DE-A-197 14 992.

The lock for doors or vehicles or the like that had been previously explained in some detail and forms the basis of the present invention is in all other respects an electrically operated lock of a modern construction in which there is further provided an electrically powered auxiliary opening drive which is switched on or activated in order to lift the lock catch component out of its full closure or preliminary or partial closure engagement for the purpose of opening the door. Even here, the release triggering criterion may be and often is a pull on either the internal or the external release or opening handle or grip when the vehicular lock is unlocked. As a result of this action, the electrical auxiliary opening drive is set in operation and thereafter acts on a lock latch component in such a manner that the latter is lifted out of its engaged position with the lock catch component. Detailed solutions addressing this aspect have been known, in principle, for quite some time, as evidenced for instance by the German patent documents DE-A-29 49 319 and DE-A-32 42 527, but also from the German patent document DE-C-43 21 586 and the European patent document EP-A-0 589 158.

In the electric motor operated drives for such purely electrically powered motor vehicle door locks, the displacement times of and the maximum force that can be applied (disengagement force) to the lock catch component are given or predetermined by the dimensioning or selection of the available motor torque, step-down ratio of the step-down transmission and the geometry or configurations of the lock latch and lock latch components. In normal operation, when the vehicle is intact and the on-board electrical network of the vehicle delivers its full design voltage to the electrically powered parts of the lock, it is possible, by using a single-stage step-down transmission, to open the vehicle door lock within a predetermined time interval of 150 milliseconds so long as the force acting on the lock catch component that is to be overcome does not exceed approximately 1,000 Newtons. However, under certain, relatively infrequently encountered circumstances or conditions (icing, accident or the like), the forces acting on and/or to be overcome before being able to release the lock catch component may be substantially higher than that, so that then the lock catch component cannot be lifted out of its engaged state without resorting to extraordinary measures. Yet, it is desirable that, even under these conditions, the electric motor powered motor vehicle door lock be able to overcome comparable forces with approximately the same response characteristic as encountered in a purely mechanically operated vehicle door lock while still achieving acceptably low displacement times. This should be achievable even if the voltage supplied by the on-board electrical network and/or by a reserve battery is significantly reduced from its nominal or design level. However, one has to bear in mind that, in such emergency or extraordinary situations, forces of up to approximately 7,500 Newtons may be acting on the lock catch component. It can then be easily imagined how high the magnitude of the frictional forces to be overcome during the disengagement of the lock catch component must be.

Even the problem discussed above has already been recognized and addressed by a variety of technical measures. A first one of such measures includes the use of a two-stage transmission for the auxiliary opening drive, which operates in normal operational mode only in one rotational sense, which can also be referred to as the normal turning direction, and which then acts on the lock latch component with a relatively low step-down transmission ratio; yet, in the emergency or extraordinary situation mentioned above, the two-stage transmission is being operated in the opposite rotational sense, which may thus also be referred to as the emergency turning direction, and then acts on the lock latch component with a considerably higher step-down transmission ratio. In this construction, when a higher than normal resistance force is encountered at the lock catch component, the occurrence of this situation is detected by an appropriate sensor located on the electric motor drive, and causes the latter to operate in the opposite rotational sense, that is in the aforementioned emergency turning direction. While operating in this reverse direction, the step-down transmission exhibits a significantly increased step-down transmission ratio, so that the lock latch component is moved towards and into its opening or disengaged position, albeit with an increased displacement time period, with a force that is sufficient for this emergency situation.

In the technical concept solution that had been mentioned before (that disclosed in the German patent document DE-A-197 10 531), which may be used in conjunction with the vehicle lock with the auxiliary closing and opening drives that constitutes the basis of the present invention (i.e. that according to the German patent document DE-A-197 14 992), the electronic control equipment must recognize when the need arises for the reversal of the rotational sense of the electric motor drive. For instance, this may be the case when, after a predetermined time interval has elapsed since the issuance of the opening command, the lock latch component has still not been lifted or disengaged, when the occurrence of too high a displacement force is sensed (e.g. the driving motor draws a higher amount of electric current than acceptable, the speed of rotation of the driving motor decreases significantly, or the like), when the occurrence of an accident has been detected by a crash sensor as is well known, when the output power of the electric driving motor is too low, for instance as the result of a decrease in the voltage delivered by the on-board electrical network or of special environmental conditions or effects, or when a switchover has taken place from the regular electric power supply equipment to an emergency electric power supply equipment.

An alternative approach to the solution of the problem of the elevated level of the opening forces to be applied in the event of an emergency resides in the provision of a spring force storage device which is loaded during the return of the auxiliary opening drive from the open position to the closed position and which enhances the advancement and lifting movement of the lock latch component by the application of the thus accumulated spring force during the movement of the auxiliary opening drive from the closed position to the open position (see for instance the German patent document DE-C-197 25 416).

Finally, it is known from the documents mentioned before (DE-C-4321 586, DE-A-32 42 527, EP-B-0 496 736) to use the auxiliary closing drive also, when being operated in the reverse direction, as an auxiliary opening drive. Inasmuch as the auxiliary closing drive is ordinarily considerably more powerful than the auxiliary opening drive, the resort to the use of this expedient makes it possible, with the proper design of the step-down transmission inclusive of appropriate selection of its step-down ratio, to obtain a level of the lifting forces acting on the lock latch component that is required for the emergency situation at hand. However, complex and hence rather expensive gear or link transmission structures have to be utilized in the prior solutions mentioned above in order to accomplish the various force application directions.

OBJECTS OF THE INVENTION

Accordingly, it is a general object of the present invention to avoid the disadvantages of the prior art.

More particularly, it is an object of the present invention to provide an electrically powered lock for motor vehicle doors or the like that does not possess the drawbacks of the known locks of this type.

Still another object of the present invention is to devise a lock of the type here under consideration which is capable of being opened even in emergency situations resulting in the existence of forces in the lock that the regular opening drive is unable to overcome.

It is yet another object of the present invention to design the above lock in such a manner as to take into account most if not all of the emergency situations that may arise.

A concomitant object of the present invention is so to construct the lock of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a lock for doors of motor vehicles or the like which includes a housing; a lock catch component mounted on the housing for movement between an initial open position and a fully closed position through an intermediate position and including a preliminary and a final abutment; a lock latch component mounted on the housing for displacement between an arresting position and a releasing position in which it engages and disengages one of the preliminary and final abutment of the lock catch component to hold the latter in and release the same for movement out of the intermediate and fully closed position, respectively; means for causing the lock latch component to disengage the one of the abutments of the lock catch component to release the latter for the movement thereof toward the initial open position, including an electrically powered auxiliary opening drive; means for moving the lock catch component from the intermediate into the fully closed position thereof, including an electrically powered auxiliary closing drive which includes a step-down transmission and means for connecting the step-down transmission with the lock latch component, including a driving- element and a coupling interposed between the driving element and the lock latch component; and means for enabling the auxiliary closing drive to act on the lock latch component as well when necessary for it to act on the latter to displace the same out of engagement with the one abutment of the lock catch component. According to the present invention, there is further provided means for controlling the operation of the drives, including means for determining the occurrence of an emergency situation involving the action on the lock catch component of excessive forces making it necessary to employ the auxiliary closing drive to accomplish the disengagement, and means for operating the auxiliary closing drive in such a manner after a demand for opening the lock has been issued in the emergency situation that the auxiliary closing drive acts to disengage the lock latch component from the lock catch component.

A particular advantage of the lock structure as described so far is that it is based on the recognition of the fact that ordinarily the auxiliary closing drive is designed and dimensioned for sustaining and exerting forces exceeding those for which the auxiliary opening drive is designed. This is then utilized in accordance with the present invention by employing the auxiliary closing drive as a sort of an "emergency opening drive". Yet, the auxiliary closing drive is used in its additional capacity as an auxiliary opening drive only in what is referred to herein as an emergency situation, that is any situation in which there is a need to apply to the lock latch component forces, torques or the like that exceed those that the regular auxiliary drive is capable of delivering at that moment for whatever reason. Of course, one has to take into account a significantly increased opening time under these circumstances. This second utility for the auxiliary closing drive despite the presence of the regular auxiliary opening drive is a peculiar feature of the teaching of the present invention.

According to another aspect of the present invention, the lock further includes means for disengaging the coupling at the commencement of the operation of the operating means at the latest. In this respect, it is particularly advantageous when the coupling includes a coupling element that is mechanically movable out of its position in which it engages its counterpart in response to a predetermined action of the auxiliary opening drive, and when the control means includes means for causing the auxiliary opening drive, after the determining means has determined the occurrence of the emergency situation, to perform the predetermined action to initially achieve the disengagement of the coupling.

The auxiliary closing drive may be operatable in a non-reversing manner; in that case, the operating means for the auxiliary closing drive is operative for leaving the latter after the completion of the movement of the lock catch component into the fully closed position thereof in an opening-readiness position that is situated considerably ahead of an initial position assumed by the auxiliary closing drive prior to the commencement of such operation thereof. However, the auxiliary closing drive may also be operatable in a reversing manner, in which case the operating means for the auxiliary closing drive is operative for returning the latter after the completion of the movement of the lock catch component into the fully closed position thereof into an initial position assumed by the auxiliary closing drive prior to the commencement of such operation thereof, and means for causing the auxiliary closing drive to move in a reverse direction in the event of the occurrence to cause the disengagement of the lock latch component from the lock catch component.

It is also advantageous when the driving element of the auxiliary closing drive is a force-transmitting lever acting on the lock catch component and including an entraining portion positioned to act on the lock latch component in the even of the occurrence. Another feature of the present invention may be found in a lock for doors of motor vehicles or the like which again includes a housing; a lock catch component mounted on the housing for movement between an initial open position and a fully closed position through an intermediate position and including a preliminary and a final abutment; a lock latch component mounted on the housing for displacement between an arresting position and a releasing position in which it engages and disengages one of the preliminary and final abutment of the lock catch component to hold the latter in and release the same for movement out of the intermediate and fully closed position, respectively; means for causing the lock latch component to disengage the one of the abutments of the lock catch component to release the latter for the movement thereof toward the initial open position, including an electrically powered auxiliary opening drive; and means for moving the lock catch component from the intermediate into the fully closed position thereof, including an electrically powered auxiliary closing drive which includes a step-down transmission and means for connecting the step-down transmission with the lock latch component, including a driving element and a coupling interposed between the driving element and the lock latch component. In this context, the present invention further includes means for controlling the operation of the drives, including means for determining the occurrence of an emergency situation involving the action on the lock catch component of excessive forces making it necessary to employ the auxiliary closing drive to aid in accomplishing the disengagement, means for operating the auxiliary closing drive in such a manner after a demand for opening the lock has been issued in the emergency situation as to move the lock catch component further in the closing direction to thereby relieve the forces acting between the lock latch component and the lock catch component, and means for subsequently operating the auxiliary opening drive to disengage the lock latch component from the lock catch component.

The construction of this lock is based, in accordance with the present invention, on the recognition of the fact that the excessive disengagement of lifting forces encountered in the emergency situations are caused, in most if not all instances, by the friction between the end surface of the lock latch component and the corresponding (abutment) surface of the lock latch component. This friction is reduced in accordance with the invention in that the auxiliary closing drive is energized at first in an emergency situation to act in the initial closing direction to move the lock latch and lock catch components slightly apart or at least to reduce the forces acting between them. Once this is accomplished, it is the regular auxiliary opening drive that actually accomplishes the opening process in the same manner as in a non-emergency situation, since the adverse effect of the excess forces on its operation has been overcome by the action of the auxiliary closing drive. However, especially in this alternative, it is important to assure, by appropriately designing the control means, that the auxiliary opening drive is caused to hold the lock latch component in its disengaged position until the lock catch component has reached its open position.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
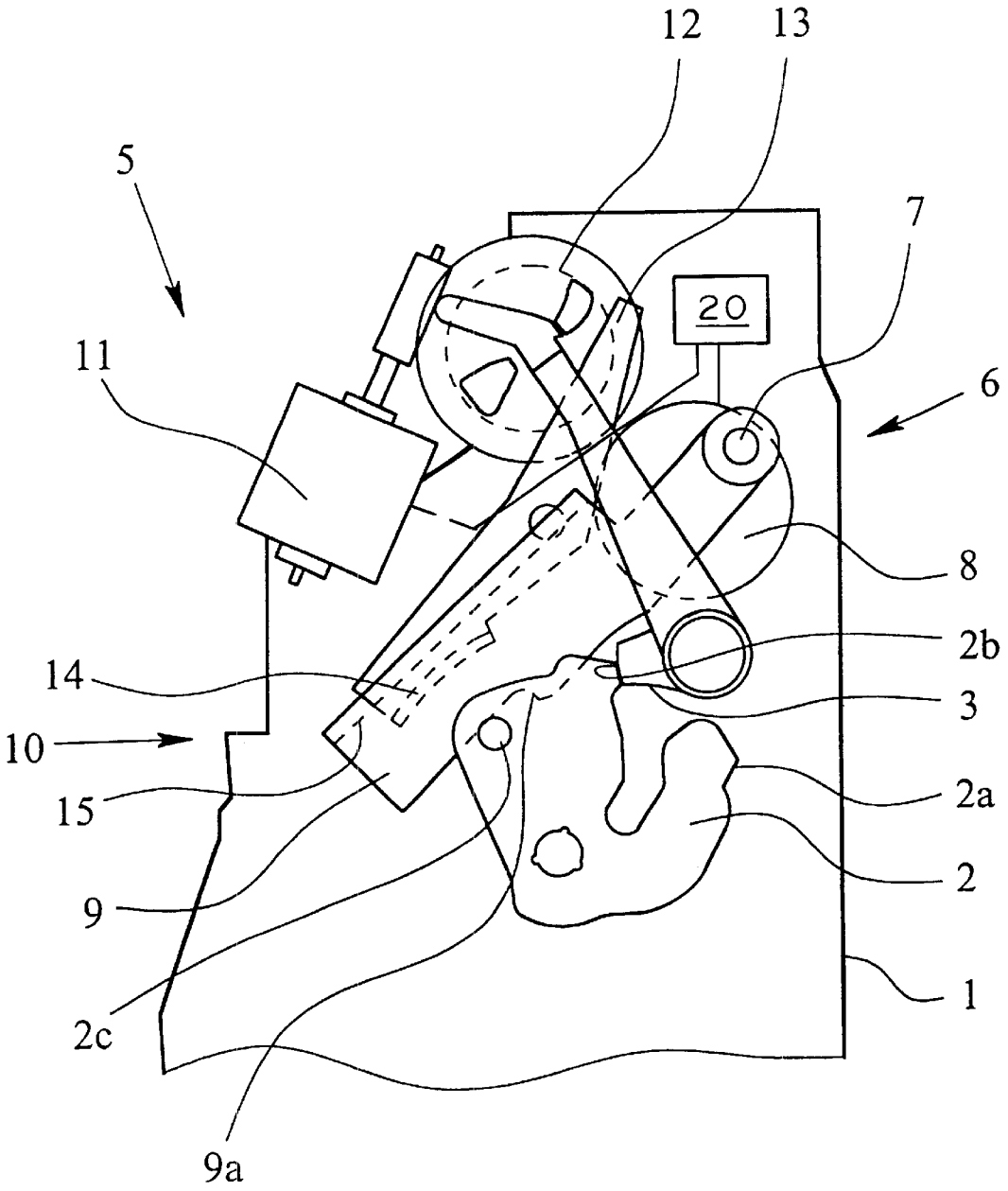
FIG. 1 is a somewhat simplified side elevational view of the interior of a known lock, especially that to be mounted in a side door of a motor vehicle, with all of its parts in a preliminary closing position.

Referring now to the drawing in detail, and first to FIG. 1 thereof, it is to be mentioned first that it shows a lock for a door of a motor vehicle or the like in a rather diagrammatic and/or simplified fashion, even to the extent that those parts that are not necessary to be shown without adversely affecting the understanding of the present invention have been omitted. The illustrated lock is well suited or even especially destined for use as a side door lock of a motor vehicle. However, the expansion or alternative possibilities mentioned in the introductory part of this specification are equally applicable here, as well as in the remainder of this disclosure. It is also to be mentioned at this juncture that, to simplify the description and consequently facilitate its understanding, corresponding parts appearing in the various Figures of the drawing have been identified by the same reference numerals even if their configurations vary from each other to some extent, so long as they perform essentially the same or corresponding functions.

At the outset, it is to be stated that in the overview picture of the door lock of a motor vehicle or the like that is presented in FIG. 1, the reference numeral 1 has been used to identify a lock housing. A lock catch component 2, here configured as a bifurcated rotationally mounted catch component, is diagrammatically indicated to be situated in the housing 1. Also diagrammatically depicted in FIG. 1 of the drawing is a lock latch component 3 which, in the illustrated situation, holds the lock catch component 2 at a preliminary abutment 2*b*. In the main or final locking position, though, the lock latch component 3 would hold the lock catch component 2 at a main abutment 2*a*, as will become clearer later.

There is further provided an electric auxiliary opening drive 5 which is shown here only in general terms, especially as the details of its construction are not relevant to the subject matter here at hand and hence need not be revealed or discussed in this disclosure. In any event, the lock latch component or lever 3 can be lifted off of or disengaged from either the preliminary abutment 2*b* or the final abutment 2*a*, as the case may be, as a result of the operation of the electrically operated auxiliary opening drive 5.

Also present but only partially shown is an electrically operated auxiliary closing drive 6 the operation of which is commenced only after the lock catch component 2 has reached its preliminary closing position (that shown in FIG. 1) and which afterwards, due to the action of its motor that is not illustrated in the drawing because of also being of a conventional construction, transfers or displaces the lock catch component 2 toward and into its main or final closed or locking position (that in which the lock latch component 3 is in engagement with the final abutment 2*a*). The aforementioned non-illustrated motor of the auxiliary closing drive 6 is preferably an electric motor. This electric motor powers and/or operates an eccentric drive arrangement of the auxiliary closing drive 6 that is shown in the drawing and that includes, a reversible step-down transmission 8 including an eccentric member carrying a bearing pin 7 on which there is pivotably mounted a driving element 9. This driving element 9 is, in turn, coupled to the lock catch component 2. This latter coupling occurs in the illustrated construction directly by means of an entrainment pin 2*c* mounted on the turnably mounted lock catch component 2. In the course of closing movements of the various components mentioned above, an engagement edge or surface 9*a* of the driving element 9 shifts the entrainment pin 2*c* and with it the remainder of the lock catch component 2, causing the latter to conduct its desired turning movement in the closing direction, as indicated by the arrow at the lock catch component 2 in FIG. 1.

In the illustrated example of the implementation of the present invention, a coupling 10 is interposed between the step-down transmission 8 and the lock catch component 2. The coupling 10 is capable of being disengaged in order to take into account the difficulties that arise in the event of the occurrence of an emergency situation or in case of malfunction as has been discussed in the introductory part of this specification. In this particular construction, the driving element 9 that had already been described before constitutes a part of this coupling 10.

FIG. 1 shows a structure of a lock for a motor vehicle door or the like that constitutes a basic construction of the type in question here but which does not yet include the features having particular relevancy to the present invention. On the other hand, FIG. 2 of the drawing shows a first embodiment of the present invention. However, various parts that have been shown in FIG. 1 but have no particular meaning in the context of or impact on the operation and function of the arrangement according to the present invention have been omitted from FIG. 2.

It can be easily ascertained from FIG. 1 of the drawing that the auxiliary closing drive 6 can also be operated as a substitute or additional opening drive. To this end, the auxiliary closing drive 6 is capable of engaging not only the lock catch component 2 but, in accordance with the present invention, even the lock latch component 3. This is accomplished in this particular illustrated embodiment by providing the driving element 9 with an entraining element or portion 9*b* which, in this illustrated structure, is in direct engagement with a cooperating associated element or portion 3*a* of the lock latch element 3.

Figure 2:
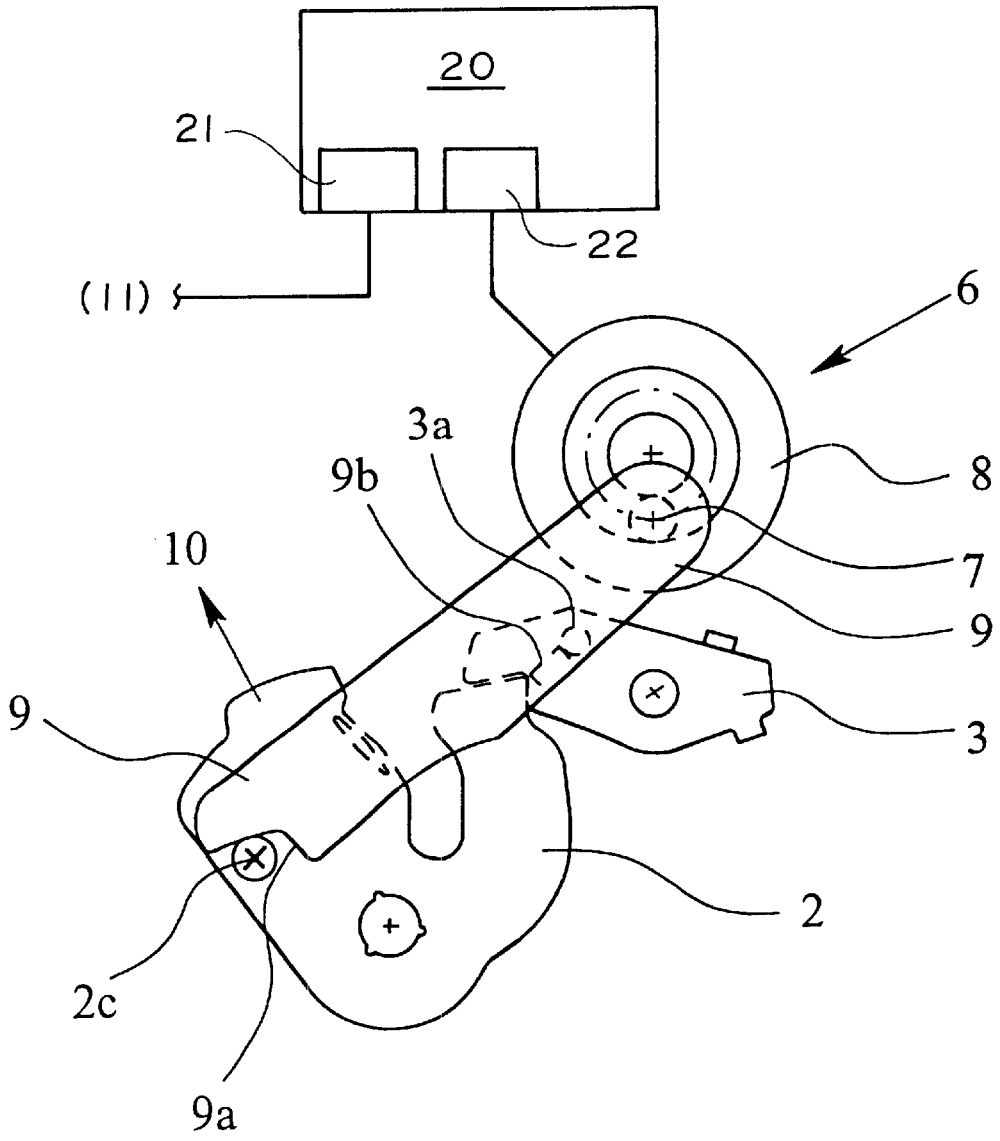
FIG. 2 is a view similar to FIG. 1 of a lock embodying the present invention but further simplified by the omission of certain parts that are not essential for understanding the present invention, with the lock catch component in its final closed position.

The operation of the lock of this construction is such that the control electronics, i.e., the means 20 for controlling the operation of the drives 5, 6, which has not been shown in the drawings, by means of an appropriately mounted sensor, when an emergency situation leading to an increased counterforce acting on the lock latching component has arisen. Extensive explanations about alternatives of accomplishing this determination are contained, to the extent not presented below, already in the introductory part of this specification. If such a determination is made, for instance by switching the auxiliary opening drive 5 on, but establishing that the electric motor 11 (see FIG. 1) of the auxiliary opening drive 5 draws too high an amount of electric current already at the commencement of the lifting or disengagement movement of the lock latch component 3, as detected by the means 21 for determining the occurrence of an emergency situation being part of the control electronics 20 as indicated by FIG. 2, then the coupling 10 is disengaged due to displacement of the driving element 9; yet, nothing more happens at this point in time. So, in this particular illustrated embodiment of the present invention, the auxiliary opening drive 9 accomplishes merely this coupling disengagement, and the control electronics 20 subsequently switches the auxiliary closing drive 6 on to act as the opening drive that achieves the actual disengagement of the lock latch component 3. This is achieved by the means 22 for operating the auxiliary closing drive 6 which is part of the control electronics as indicated in FIG. 2.

In the embodiment illustrated in FIG. 2 of the drawing, this leads to a situation in which the auxiliary closing drive 6, which operates in a non-reversing manner under these circumstances and which, after bringing the lock catch component 2 into its main or final closing or locking position, has terminated its movement in an opening readiness position in which it lies considerably ahead of its initial position (FIG. 2), is caused to move again in the same turning direction as before, eventually to return into its initial position. In the course of this turning movement, the entraining portion 9*b* of the drive element 9 entrains the associated portion 3*a* of the lock latch component 3 for joint travel therewith in the upward and rightward direction as considered in FIG. 2 of the drawing, lifting or disengaging the lock latch component 3 in the process. Incidentally, the disengagement movement of the coupling 10 is indicated in FIG. 2 of the drawing by a corresponding arrow.

Figure 3:
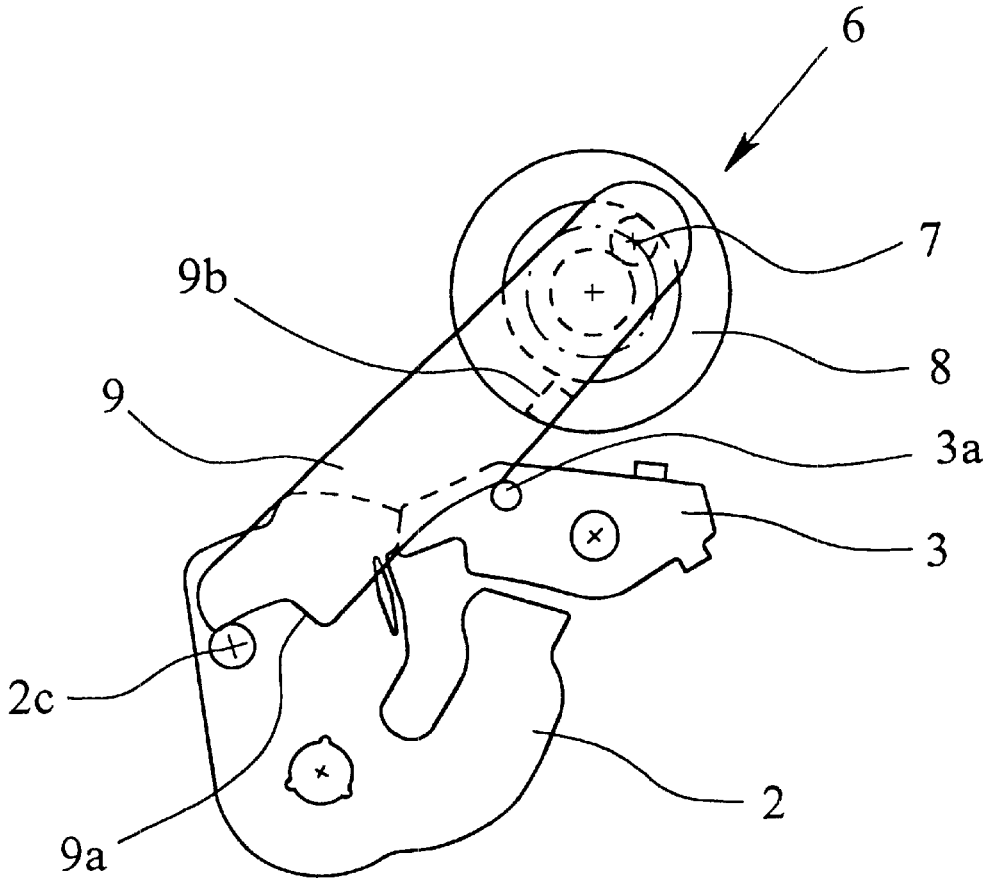
FIG. 3 is a view corresponding to that of FIG. 2 but taken after the lock opening process has been completed but with the lock catch component in its preliminary closing position.

In FIG. 3 of the drawing, the lock latch component 3 has reached its position of engagement with the preliminary abutment 2*b*, that is, it has once more fallen in. This corresponds in concept to a situation in which the main if not only quest is to reduce the loading of the lock latch component 3. As soon as the excessively high counterforces acting on the lock latch component 3 are reduced to an acceptable level as a result of relieving the load thereon, the normal auxiliary opening drive 5 can resume its intended function. However, in an alternative and in contrast to what has just been said, it is also possible and proposed herein to hold the lock latch component 3 in its lifted position until the lock catch component has reached its open position. Incidentally, in FIG. 3 of the drawing, the auxiliary closing drive 6 is shown in its initial position that it assumes in this particular construction.

FIG. 1 of the drawing also shows, in some more detail, the construction of the coupling 10 that, in the illustrated embodiment of the present invention, incorporates the driving element 9. One should be able to recognize, on the driving element 12 of the step-down transmission, an uncoupling lever 13 that accomplishes, in concert with corresponding, possibly arcuate, coupling portions or elements 14 and 15, the uncoupling movement of the driving element 9 as a part of the coupling 10.

Figure 4:
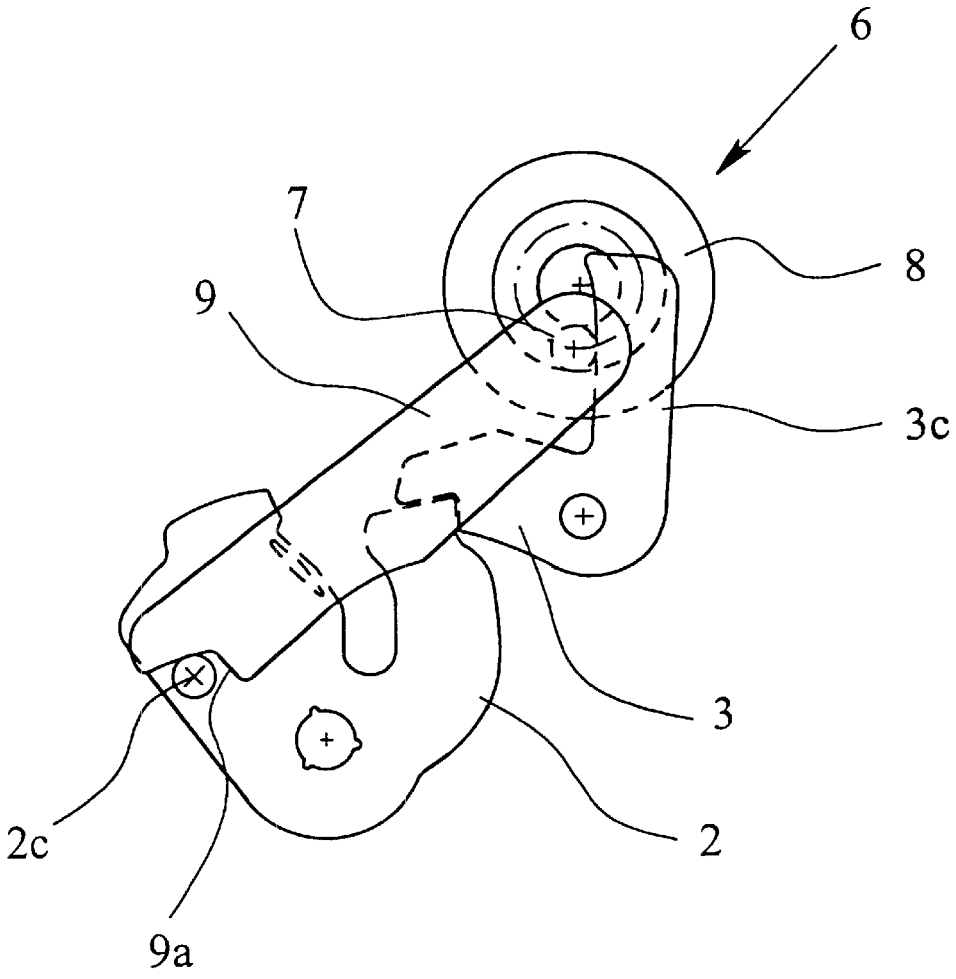
FIG. 4 is a view akin to that of FIG. 2 but showing a modified version of the lock.

FIG. 4. of the drawing shows another, further slightly modified, embodiment in which the driving element 9 does not extend transversely of and over the lock catch component 2 and the lock latch component 3 to accomplish at the proper location a direct coupling to the lock latch component 3; rather, the lock latch component 3 is provided with a second arm 3*c* that extends to the region of the bearing pin 7 of the auxiliary closing drive 6. In this situation, it is the bearing pin 7 which causes the lifting of the lock latch component 3 by means of its second arm 3*c* after the bearing pin 7 has resumed its movement in the counterclockwise direction. Thus, the auxiliary closing drive 6 operates here in a non-reversing manner. Furthermore, after the displacement of the lock catch component 2 into its main or final locking position, the auxiliary closing drive 6 remains even here in an opening-ready position (the position depicted in FIG. 4) which, of course, lies significantly ahead of the initial position. The auxiliary closing drive 6 can then, after the lifting of the lock latch component 3, again reach its initial position which is shown in FIG. 3 of the drawing, albeit for a slightly different structure.

It is applicable even here that the coupling 10 is important in order to assure that the opening movement of the lock catch component 2, which is rendered possible after the lifting of the lock latch component 3, is not again impeded or hindered by the driving element 9 of the auxiliary closing drive 6.

Figure 5:
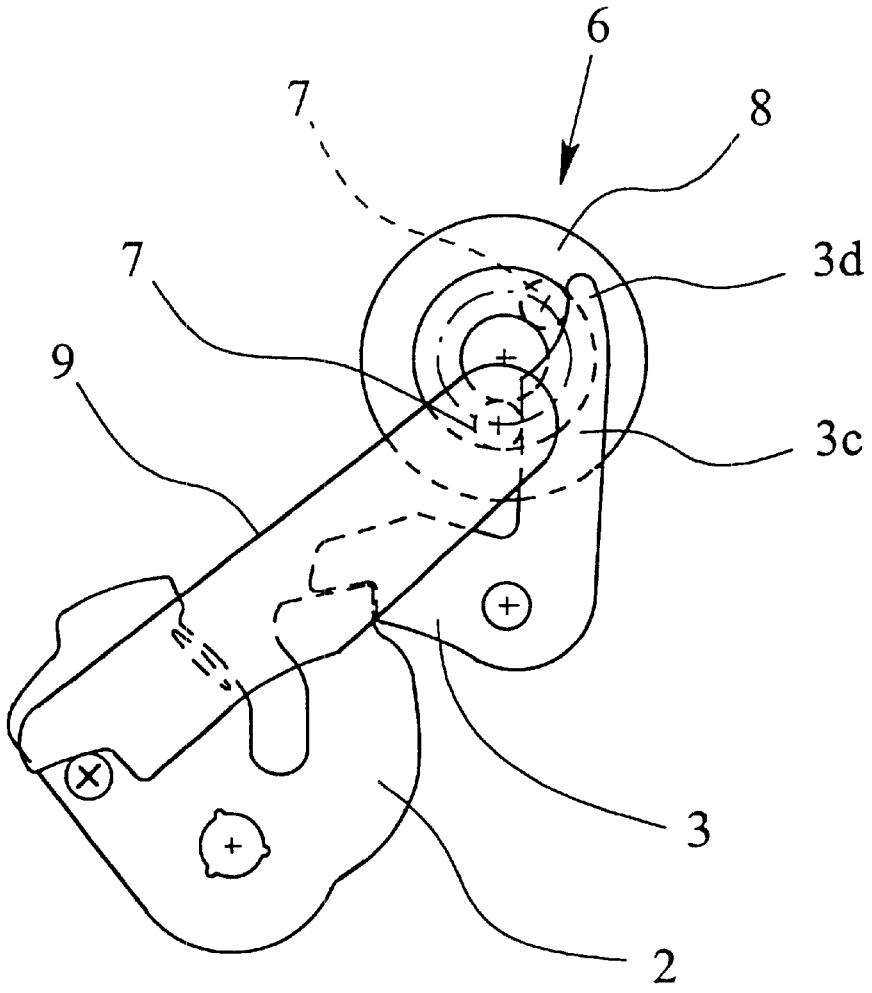
FIG. 5 is a another view corresponding to that of FIG. 2 but depicting a further modified implementation of the lock of the present invention.

A further modified version is shown in FIG. 5 of the drawing. Unlike before, it is proposed in this construction for the auxiliary closing drive 6 to operate in a reversible fashion, and to return into its initial position after the completion of the displacement of the lock catch component 2 into its final closing position (or after an intervening interruption of the movement) and to effectuate the lifting of the lock latch component 3 from there while turning in the opposite direction, serving as an opening drive.

Even here, the lock latch component 3 is provided with an arm 3*c* that extends into the range or path of movement of the bearing pin 7. What is shown in broken lines, inclusive the lead line, in FIG. 5 of the drawing, is what had been alluded to before, that is that during the reverse (clockwise) movement of the auxiliary closing drive 6 for the purpose of opening, the bearing pin 7 moves in the same sense out of its initial position, eventually encountering or coming in contact with the arm 3*c* of the lock latch component 3. The latter is provided for this purpose with a protuberance 3*d* for this purpose. After the initial contact of the bearing pin 7 with the protuberance 3*d*, it is possible to lift the lock latch component 3 out of the lock catch component 2 as the auxiliary closing drive 6 continues its operation in the reverse direction and the bearing pin 7 rides along the corresponding cam surface of the protuberance 3*d* of the lock latch component 3. Moreover, the modified construction shown in FIG. 5 additionally offers the possibility that is indicated in solid lines and that had already been discussed before in conjunction with FIG. 4 of the drawing.

The example of the implementation of the present invention that is revealed in FIG. 5 of the drawing can be complemented or completed in such a manner that the auxiliary opening drive 5 can possibly be dispensed with altogether. This brings about the advantages arising from the elimination of a concrete drive that have been alluded to in the general part of this description. In this scenario, the auxiliary closing drive 6 would always be used to perform the opening function as well; it would even be possible to operate selectively with a reversing or a non-reversing control of the auxiliary closing drive 6.

A variant in which a different kind of operation control for the auxiliary closing drive 6 is executed is not shown in the drawing; however, this variant can readily be visualized and understood without being specifically illustrated by considering, for example, FIG. 1 of the drawing. In this case, it is proposed for the control electronics to determine by means of an appropriate sensor, when an emergency situation that would lead to encountering an increased force at the lock latch component 3 has arisen and, once this determination has been made and a demand is detected for the performance of the lock opening or release function, to operate the auxiliary closing drive 6 further in its closing direction whereby the latter moves the lock catch component 2 into a position of a slight overstroke, which relieves the forces acting at the abutment surfaces between the lock catch component 2 and the lock latch component 3. Thereafter, the auxiliary opening drive 5 lifts the lock latch component 3 off of the lock catch component 2 while the load previously or otherwise acting on them is relieved or discontinued altogether.

Last but not least, it is recommended and proposed generally in accordance with the present invention that the auxiliary opening drive 5 hold the lock latch component 3 in its lifted position until the lock catch component 2 has reached its completely open position. Then, the movement of the lock latch component 3 during the opening process into its position of engagement in the preliminary arresting position that is indicated in FIG. 3 of the drawing is avoided. Yet, the falling in into the preliminary arresting condition shown in FIG. 3 has, on the other hand, the advantage that the opening process can be continued from there by using the control of the auxiliary opening drive 5 that is used under normal, non-emergency, circumstances.

It will be understood that each of the elements described above, or two or more together, may also find a useful application in other types of constructions differing from the type described above.

While the present invention has been described and illustrated herein as embodied in specific constructions of a side door lock of a passenger car, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims:

What is claimed is:

1. A lock for doors of motor vehicles, comprising a housing, a lock catch component mounted on said housing for movement between an initial open position and a fully closed position through an intermediate position and including a preliminary and a final abutment; a lock latch component mounted on said housing for displacement between an arresting position and a releasing position in which it engages and disengages one of said preliminary and final abutment of said lock catch component to hold the latter in and release the same for movement out of said intermediate and fully closed position, respectively; means for causing said lock latch component to disengage said one of said abutments of said lock catch component to release the latter for said movement thereof toward said initial open position, including an electrically powered auxiliary opening drive, means for moving said lock catch component from said intermediate into said fully closed position thereof, including an electrically powered auxiliary closing drive which includes a step-down transmission and means for connecting said step-down transmission with said lock latch component, including a driving element and a coupling interposed between said driving element and said lock latch component; means for enabling said auxiliary closing drive to act on said lock latch component as well when necessary for it to act on the latter to displace the same out of engagement with said one abutment of said lock catch component; and means for controlling the operation of said drives including means for determining the occurrence of an emergency situation involving the action on said lock catch component of excessive forces making it necessary to employ said auxiliary closing drive to accomplish said disengagement, and means for operating said auxiliary closing drive in such a manner after a demand for opening the lock has been issued in said emergency situation that said auxiliary closing drive acts to disengage said lock latch component from said lock catch component.

2. The lock as defined in claim 1, and further comprising means for disengaging said coupling at the commencement of the operation of said operating means at the latest.

3. The lock as defined in claim 1, wherein said coupling includes a coupling element that is mechanically movable out of its position in which it engages its counterpart in response to a predetermined action of said auxiliary opening drive; and wherein said control means includes means for causing said auxiliary opening drive, after said determining means has determined the occurrence of said emergency situation, to perform said predetermined action to initially achieve said disengagement of said coupling.

4. The lock as defined in claim 1, wherein said auxiliary closing drive is operatable in a non-reversing manner; and wherein said operating means for said auxiliary closing drive is operative for leaving the latter after the completion of the movement of said lock catch component into said fully closed position thereof in an opening-readiness position that is situated considerably ahead of an initial position assumed by said auxiliary closing drive prior to the commencement of such operation thereof.

5. The lock as defined in claim 1, wherein said auxiliary closing drive is operatable in a reversing manner; and wherein said operating means for said auxiliary closing drive is operative for returning the latter after the completion of the movement of said lock catch component into said fully closed position thereof into an initial position assumed by said auxiliary closing drive prior to the commencement of such operation thereof, and means for causing said auxiliary closing drive to move in a reverse direction in the event of said occurrence to cause said disengagement of said lock latch component from said lock catch component.

6. The lock as defined in claim 1, wherein said driving element of said auxiliary closing drive is a force-transmitting lever acting on said lock catch component and including an entraining portion positioned to act on said lock latch component in the even of said occurrence.

7. The lock as defined in claim 1, wherein said control means is operative for causing said auxiliary opening drive to hold said lock latch component in its disengaged position until said lock catch component has reached its open position.

8. A lock for doors of motor vehicles, comprising a housing; a lock catch component mounted on said housing for movement between an initial open position and a fully closed position through an intermediate position and including a preliminary and a final abutment; a lock latch component mounted on said housing for displacement between an arresting position and a releasing position in which it engages and disengages one of said preliminary and final abutment of said lock catch component to hold the latter in and release the same for movement out of said intermediate and fully closed position, respectively; means for causing said lock latch component to disengage said one of said abutments of said lock catch component to release the latter for said movement thereof toward said initial open position, including an electrically powered auxiliary opening drive; means for moving said lock catch component from said intermediate into said fully closed position thereof, including an electrically powered auxiliary closing drive which includes a step-down transmission and means for connecting said step-down transmission with said lock catch component, including a driving element and a coupling interposed between said driving element and said lock catch component; and means for controlling the operation of said drives, including means for determining the occurrence of an emergency situation involving the action on said lock catch component of excessive forces making it necessary to employ said auxiliary closing drive to aid in accomplishing said disengagement, means for operating said auxiliary closing drive in such a manner after a demand for opening the lock has been issued in said emergency situation as to move said lock catch component further in the closing direction to thereby relieve the forces acting between said lock latch component and said lock catch component, and means for subsequently operating said auxiliary opening drive to disengage said lock latch component from said lock catch component.

9. The lock as defined in claim 8, wherein said control means is operative for causing said auxiliary opening drive to hold said lock latch component in its disengaged position until said lock catch component has reached its open position.

* * * * *